US008367580B2

(12) United States Patent
Halbrook et al.

(10) Patent No.: US 8,367,580 B2
(45) **Date of Patent: *Feb. 5, 2013**

(54) DUAL-SIDED THERMAL SECURITY FEATURES

(75) Inventors: Wendell B Halbrook, Waynesville, OH (US); Maryann Wehr, Hamiltion, OH (US); Michael J. VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 203 days.

This patent is subject to a terminal disclaimer.

(21) Appl. No.: 11/549,463

(22) Filed: Oct. 13, 2006

(65) Prior Publication Data

US 2007/0210572 A1 Sep. 13, 2007

Related U.S. Application Data

(60) Provisional application No. 60/779,781, filed on Mar. 7, 2006, provisional application No. 60/779,782, filed on Mar. 7, 2006.

(51) Int. Cl.
*B41M 5/26* (2006.01)

(52) U.S. Cl. ..... 503/201; 503/226; 283/94

(58) Field of Classification Search ..... 503/200, 503/201, 206, 226, 227; 428/916; 283/72, 283/74, 94; 427/150, 151, 152
See application file for complete search history.

(56) References Cited

U.S. PATENT DOCUMENTS

| | | | |
|---|---|---|---|
| 3,466,423 | A | 9/1969 | Janning |
| 3,518,406 | A | 6/1970 | Janning |
| 3,663,390 | A | 5/1972 | Fergason et al. |
| 4,161,277 | A | 7/1979 | Steiner |
| 4,631,596 | A | 12/1986 | Yaguchi |
| 4,806,950 | A | 2/1989 | Sekine et al. |
| 4,853,256 | A | 8/1989 | Obringer et al. |
| 4,924,275 | A | 5/1990 | Nelson |
| 4,987,118 | A | 1/1991 | Murata et al. |
| 5,101,222 | A | 3/1992 | Hakkaku |

(Continued)

FOREIGN PATENT DOCUMENTS

| | | |
|---|---|---|
| CN | 1065536 | 2/1992 |
| CN | 1065536 A | 10/1992 |

(Continued)

OTHER PUBLICATIONS

Robert L. Caret et al., Foundations of Inorganic, Organic, & Biological Chemistry, vii-x and 1-4 (Wm. C. Brown Publishers 1995).*

(Continued)

*Primary Examiner* — Bruce H Hess
*Assistant Examiner* — David J Joy
(74) *Attorney, Agent, or Firm* — Joseph P. Merhle; Dana T. Hustins

(57) ABSTRACT

There is provided a method for providing a security enabled dual-sided thermal medium, which includes imaging a first side of the thermal medium with a first data security feature, and imaging a second side of the thermal medium with a second data security feature. There is also provided a security enabled dual-sided thermal medium, which includes a first data security feature disposed at a predetermined location of a first side of the thermal medium, and a second data security feature disposed at a predetermined location of a second side of the thermal medium. Additionally, there is provided a system for providing a security enabled dual-sided thermal medium, which includes a dual-sided direct thermal printer adapted to image a first side of the thermal medium with a first data security feature and image a second side of the thermal medium with a second data security feature.

16 Claims, 5 Drawing Sheets

U.S. PATENT DOCUMENTS 5,130,292 A 7/1992 Ito et al.
5,132,704 A 7/1992 Nakagawa
5,196,297 A 3/1993 Dombrowski, Jr. et al.
5,214,750 A 5/1993 Minowa et al.
5,219,821 A 6/1993 Arbee et al.
5,266,550 A 11/1993 Asajima et al.
5,272,127 A 12/1993 Mandoh et al.
5,284,816 A 2/1994 Stephenson
5,319,392 A 6/1994 Durst et al.
5,339,099 A 8/1994 Nureki et al.
5,366,952 A 11/1994 Granquist
5,398,305 A 3/1995 Yawata et al.
5,428,714 A 6/1995 Yawata et al.
5,437,004 A 7/1995 Miyasaka et al.
5,476,698 A 12/1995 Denny
5,537,550 A 7/1996 Russell et al.
5,555,349 A 9/1996 Miyasaka et al.
5,584,590 A 12/1996 Ito et al.
5,585,321 A 12/1996 Breen et al.
5,594,653 A 1/1997 Akiyama et al.
5,629,259 A 5/1997 Akada et al.
5,639,169 A 6/1997 Aruga
5,667,134 A * 9/1997 Olson et al. ..... 229/92.8
5,667,303 A 9/1997 Arens et al.
5,677,722 A 10/1997 Park
5,686,159 A 11/1997 Langan
5,688,057 A 11/1997 Wright et al.
5,692,110 A 11/1997 Miyasaka et al.
5,707,925 A 1/1998 Akada et al.
5,710,094 A 1/1998 Minami et al.
5,727,135 A 3/1998 Webb
5,741,592 A 4/1998 Lewis et al.
5,754,213 A 5/1998 Whritenor
5,755,521 A 5/1998 Ito et al.
5,756,188 A 5/1998 Reiter et al.
5,763,356 A 6/1998 Ueno et al.
5,781,823 A 7/1998 Isobe et al.
5,789,340 A 8/1998 Brust et al.
5,792,725 A 8/1998 Simpson et al.
5,794,530 A 8/1998 Dobashi et al.
5,800,081 A 9/1998 Teradaira et al.
5,815,191 A 9/1998 Michielsen et al.
5,846,900 A 12/1998 Reiter et al.
5,876,836 A 3/1999 Imamura et al.
5,883,043 A 3/1999 Halbrook, Jr. et al.
5,886,725 A 3/1999 Miyadera et al.
5,912,205 A * 6/1999 Lakes et al. ..... 503/207
5,918,910 A 7/1999 Stillwagon et al.
5,961,228 A 10/1999 Ward et al.
5,964,541 A 10/1999 Murison et al.
5,980,128 A 11/1999 Verlinden et al.
6,000,726 A 12/1999 Campbell
6,000,867 A 12/1999 Yoshii et al.
6,042,264 A 3/2000 Prusik et al.
6,095,414 A 8/2000 Long et al.
6,106,910 A 8/2000 Tan et al.
6,118,956 A 9/2000 Hirao
6,130,185 A 10/2000 Narita et al.
6,150,067 A 11/2000 Koike et al.
6,151,037 A 11/2000 Kaufman et al.
6,165,937 A 12/2000 Puckett et al.
6,197,722 B1 3/2001 Irving et al.
6,210,517 B1 4/2001 Eadara et al.
6,210,777 B1 4/2001 Vermeulen et al.
6,233,057 B1 5/2001 Ota
6,241,386 B1 6/2001 Limburg et al.
6,258,746 B1 7/2001 Mehta
6,267,052 B1 7/2001 Hill et al.
6,350,072 B1 2/2002 Nunes et al.
6,388,692 B1 5/2002 Iwata et al.
6,416,154 B1 7/2002 Silverbrook
6,523,951 B2 2/2003 Takeya et al.
6,524,000 B1 2/2003 Roth
6,543,808 B1 4/2003 Mitchell, Jr. et al.
6,544,709 B1 4/2003 Wang et al.
6,544,925 B1 4/2003 Prusik et al.
6,562,755 B1 5/2003 Halbrook, Jr. et al.
6,613,403 B2 * 9/2003 Tan et al. ..... 428/29
6,663,304 B2 12/2003 Vives et al.
6,705,786 B2 3/2004 Trovinger
6,737,137 B2 5/2004 Franko, Sr. et al.
6,759,366 B2 7/2004 Beckerdite et al.
6,784,906 B2 * 8/2004 Long et al. ..... 347/171
6,786,263 B1 9/2004 Fox, Jr. et al.
6,801,233 B2 10/2004 Bhatt et al.
6,803,344 B2 10/2004 Halbrook et al.
6,812,943 B1 11/2004 Day et al.
6,906,735 B2 6/2005 Bhatt et al.
6,962,449 B2 11/2005 Lermant et al.
6,962,763 B2 11/2005 Maskasky et al.
6,982,737 B2 1/2006 Elko et al.
7,192,904 B2 3/2007 Iwasaki et al.
7,514,262 B2 4/2009 Ribi
7,520,586 B2 4/2009 Itoh
7,589,752 B2 9/2009 Janning
7,623,145 B2 11/2009 Taguchi
7,671,878 B2 3/2010 Yamada et al.
7,760,370 B2 7/2010 Oki
2001/0034775 A1 10/2001 Minowa
2002/0122188 A1 9/2002 Elko et al.
2002/0124950 A1 9/2002 Klima
2003/0025779 A1 2/2003 Miyazaki
2003/0031861 A1 2/2003 Reiter et al.
2003/0112318 A1 6/2003 Long et al.
2003/0119669 A1 * 6/2003 Halbrook et al. ..... 503/200
2003/0208560 A1 11/2003 Inoue et al.
2003/0211296 A1 * 11/2003 Jones et al. ..... 428/195.1
2004/0046971 A1 3/2004 Lapstun et al.
2004/0084631 A1 5/2004 Spoonhower et al.
2004/0135872 A1 7/2004 Burdenko
2004/0265542 A1 12/2004 Yanagisawa et al.
2005/0020387 A1 1/2005 Kennedy, III
2005/0031392 A1 2/2005 Yamamoto et al.
2005/0146739 A1 7/2005 Rayl et al.
2005/0146740 A1 7/2005 Fukuda
2005/0148467 A1 7/2005 Makitalo et al.
2005/0164881 A1 7/2005 Kenney et al.
2005/0271866 A1 12/2005 Lee
2006/0072001 A1 4/2006 Klein
2006/0289633 A1 12/2006 Moreland et al.
2007/0109349 A1 5/2007 Tanaka et al.
2007/0207926 A1 9/2007 VanDemark et al.
2007/0223022 A1 9/2007 Suzuki
2009/0184510 A1 7/2009 Frankel
2009/0195584 A1 8/2009 Itoh
2009/0225353 A1 9/2009 Ishibashi
2010/0225932 A1 9/2010 Kurose et al.

FOREIGN PATENT DOCUMENTS

EP 0552956 7/1993
EP 0947340 10/1999
EP 1 862 318 5/2007
EP 1 862 319 5/2007
GB 2 250 478 6/1992
JP 58008668 1/1983
JP 58051172 3/1983
JP 58051172 5/1983
JP 03234560 10/1991
JP 03293171 12/1991
JP H07-061141 8/1993
JP H07061141 8/1993
JP 06262786 9/1994
JP H09-086041 9/1995
JP H09086041 9/1995
JP 08-127152 5/1996
JP 08127152 5/1996
JP 08-169127 7/1996
JP 09-183427 7/1997
JP 2000315275 11/2000
JP 2001080131 3/2001
JP 2001-199095 7/2001
JP 2001199095 7/2001
JP 2003-251595 9/2003
JP 2003251595 9/2003
JP 09-183427 9/2004
JP 2006-095755 4/2006
JP 2006095755 4/2006

| | | |
|---|---|---|
| JP | 2006-256289 | 9/2006 |
| JP | 2006256289 | 9/2006 |
| RU | 2088969 | 8/1997 |
| WO | 02096665 | 12/2002 |
| WO | 2004/077001 A1 | 9/2004 |
| WO | 2004077001 | 9/2004 |
| WO | 2007/102879 | 9/2007 |
| WO | 2007102879 | 9/2007 |

OTHER PUBLICATIONS

Chu-Carroll, "Good Math, Bad Math Transposition Ciphers", Scienceblogs.com, Aug. 24, 2008.*

JP Abstract, vol. 007,No. 063 (M-200), Mar. 16, 1983 & JP 57-208298 A (Ricoh KK), Dec. 21, 1982.

JP Abstract, vol. 007, No. 081 (M-105), Apr. 5, 1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 61-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

APTi PowerEcoT R2412 printer brochure.

* cited by examiner

DUAL-SIDED THERMAL SECURITY FEATURES

CROSS REFERENCE TO RELATED APPLICATIONS

This application claims priority to U.S. Provisional Application No. 60/779,781 entitled "Two-Sided Thermal Printing" and filed on Mar. 7, 2006, and U.S. Provisional Application No. 60/779,782 entitled "Dual-Sided Thermal Printer" and filed on Mar. 7, 2006; the disclosures of which are hereby incorporated by reference herein.

TECHNICAL FIELD

This disclosure relates to dual sided thermal printing. More particularly, this disclosure is directed to dual-sided thermal security features.

BACKGROUND

In many industries and applications there has been a shift away from printing documents on bond paper, including transaction documents (e.g., receipts, tickets, gift certificates, sweepstakes and the like), toward printing documents on direct thermal paper (e.g., thermal media).

Security features for determining the authenticity of printed transaction documents have been used on transaction documents employing single-sided direct thermal media. However, security features in the transaction documents that would mitigate fraud more completely have remained illusive. For example, the lottery industry has employed secure ticketing applications, required security controls, preprinted security features, and designed strict security methods to validate and authenticate winning lottery tickets.

Direct thermal printers have been used to image the thermal media. Often, information is printed or imaged only on one side of the document. Dual-sided direct thermal printing of documents, such as transaction documents, is described in U.S. Pat. Nos. 6,784,906 and 6,759,366. In dual-sided direct thermal printing, the printer is configured to allow concurrent printing on both sides of a thermal media moving along a feed path through the thermal printer. In such a printer, a direct thermal print head is disposed on each side of the thermal media along the feed path. In operation, each thermal print head faces an opposing platen across the thermal media from the respective print head. During printing, the opposing print heads selectively apply heat to the opposing sides of the thermal media, which comprises a substrate with a thermally sensitive coating on each of the opposing surfaces of the substrate. The coating changes color when heat is applied, such that printing is provided on the coated substrate.

As the authenticity of documents is of importance in many industries and applications, it would be advantageous to provide improved dual-sided thermal security features to mitigate fraud.

SUMMARY

In accordance with an embodiment, there is provided a method for providing a secure dual-sided thermal medium, the method comprising: imaging a first side of the thermal medium with a first data security feature; and imaging a second side of the thermal medium with a second data security feature.

In accordance with another embodiment, there is provided a secure dual-sided thermal medium, the thermal medium comprising: a first data security feature disposed at a predetermined location of a first side the thermal medium; and a second data security feature disposed at a predetermined location of a second side the thermal medium.

In accordance with yet another embodiment, there is provided a system for providing a security enabled dual-sided thermal medium, the system comprising: a dual-sided direct thermal printer adapted to image a first side of the thermal medium with a first data security feature and image a second side of the thermal medium with a second data security feature.

BRIEF DESCRIPTION OF THE DRAWINGS

Various features and attendant advantages of the example embodiments will be more fully appreciated as the same becomes better understood when considered in conjunction with the accompanying drawings, in which like reference characters designate the same or similar parts throughout the several views, and wherein.

DETAILED DESCRIPTION

Figure 1:
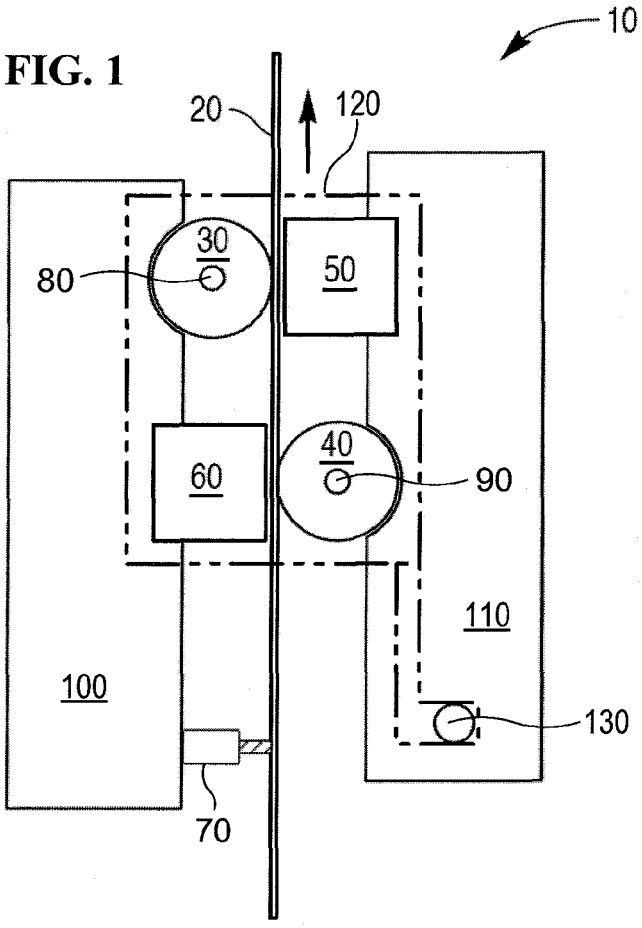
FIG. 1 illustrates a schematic of an example dual-sided imaging direct thermal printer.

FIG. 1 illustrates a schematic of an example dual-sided imaging direct thermal printer 10 useable for dual-sided printing of thermal print media 20 to produce a document, such as a transaction document (e.g., receipt, ticket, gift certificate and the like). It is to be noted that printer 10 may print a variety of other documents such as sweepstakes, coupons, vouchers, as well as many others not enumerated herein. Thermal printer 10 comprises support arms 100 and 110. Second support arm 110 may be journaled on an arm shaft 130 to permit arm 110 to pivot or rotate in relation to arm 100. The support arms 100 and 110 may also be in a fixed relation to one another.

Further with reference to FIG. 1, thermal printer 10 further comprises platens 30 and 40 and opposing thermal print heads 50 and 60 on opposite sides of the thermal print media 20. More specifically, first support arm 100 comprises a first platen 30 and a first print head 60, and the second support arm 110 comprises a second platen 40 and a second print head 50. The platens 30 and 40 are substantially cylindrical in shape. The first platen 30 may be journaled on a first shaft 80 and the second platen 40 may be journaled on a second shaft 90. Each of shafts 80 and 90 are coupled to the support arms 100 and 110, respectively. Platens 30 and 40 are further rotatable via drive assembly 120 about shafts 80 and 90, respectively, for moving thermal print media 20 through the printer 10. The drive assembly 120 comprises a motor (not shown) for powering a system of gears, links, cams, and combinations thereof. The first and second print heads 50 and 60 may be any print heads suitable for direct thermal printing, such as those disclosed in U.S. Pat. Nos. 3,947,854; 4,708,500; and 5,964,541. Thermal printer 10 further comprises a sensor 70 for determining various conditions to control the operation of the thermal printer 10, such as a media sensor to detect a paper out condition.

Still further with reference to FIG. 1, thermal printer 10 operates on thermal print media 20, which may be supplied in the form of a continuous paper roll, a continuous fan-folded stack or cut sheet stock, and upon which features such as graphics or text, and combinations thereof, including security features, may be printed on one or both sides thereof, to provide the printed document, such as for example, a transaction document described above. Thermal print media 20 for printing transaction documents including security features will be described in greater detail with reference to FIGS. 2A-3D. Thermal print media 20 may be a double-sided thermal paper, e.g., comprising a cellulosic or polymer substrate sheet coated on each side with heat sensitive dyes as described in U.S. Pat. Nos. 6,784,906 and 6,759,366; the contents of which are incorporated by reference herein. Dual-sided direct thermal printing may be facilitated by, for example, thermal print media 20, which includes dyes on opposite sides of the print media 20, and a sufficiently thermally resistant substrate that inhibits thermal printing on one side of the print media 20 from affecting thermal printing on the opposite side of print media 20.

With further reference to FIG. 1, the dual-sided direct thermal printing of the print media 20 may be accomplished in a single pass process. Alternately, dual-sided direct thermal printing may be accomplished in a process where the media 20 may be imaged by one or both of the thermal print heads 50 and 60 when moving in a first direction, and then retracted for further imaging by the one or both thermal print heads 50 and 60 with the media moving in either the first or the second, retract direction. Once printing is completed, the print media 20 may be manually or automatically cut or detached to form the printed document, which is described in greater detail below with reference to FIGS. 2C-2D and 3C-3D.

Figure 2A:
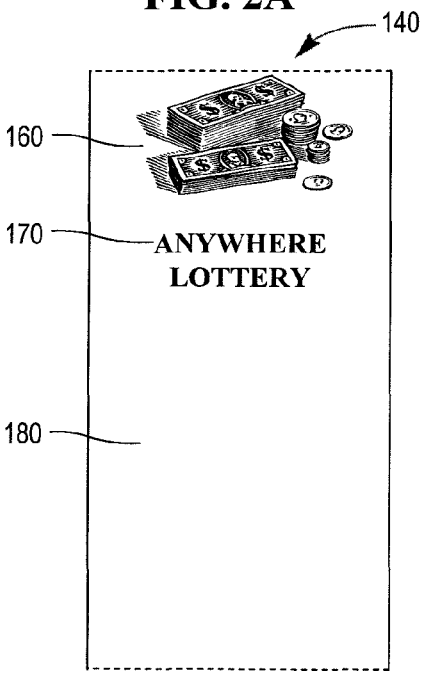
FIGS. 2A-2B illustrate an example first side and an example second side of a preprinted transaction document for imaging using the example dual-sided imaging direct thermal printer, in accordance with FIG. 1.
Figure 2B:
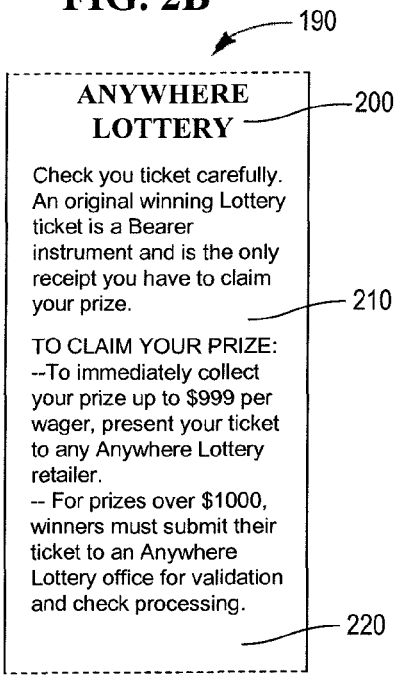

FIGS. 2A-2B illustrate an example first side 140 and an example second side 190 of a preprinted transaction document for imaging using the example dual-sided imaging direct thermal printer, in accordance with FIG. 1. As was described hereinabove with reference to FIG. 1, thermal print media 20 including multiple preprinted transaction documents of FIGS. 2A-2B may be supplied in a continuous thermal print media roll, a continuous fan-folded stack or cut sheet stock for printing transaction documents using the dual-sided imaging direct thermal printer 10 of FIG. 1.

Further with reference to FIGS. 2A-2B, the first (front) side 140 may include a transaction logo 160 and a transaction title 170, as well as including a printing surface 180 upon which transaction detail may be imaged using the dual-sided imaging direct thermal printer 10 of FIG. 1. The transaction logo 160 may include an embedded logo security feature. More specifically, the embedded logo security feature represents all or a portion of the transaction logo 160 preprinted using one or more security inks described below with reference to FIGS. 3A-3B. The second (reverse) side 190 may also include a transaction title 200, transaction-related information 210 and printing surface 220. The transaction title 200 may be similar or different from the transaction title 170 on the first side 140. Although the transaction logo 160 is not depicted on the second side 190 for brevity, a transaction logo that is similar to or different from transaction logo 160 may likewise be preprinted on the second side 190. It is noted that any of the transaction logo 160, transaction titles 170, 200 and transaction-related information 210 may be imaged instead of being preprinted depending on particular requirements of the industry or the application.

Still further with reference to FIGS. 2A-2B, the preprinting on the transaction document may follow the manufacturing process of the thermal print media 20 that is described in U.S. Pat. No. 6,784,906, which is incorporated by reference herein. The preprinting may be achieved via a media converting process, which prints the subject mater described above (elements 160, 170, 200, 210) on the thermal print media 20. In an embodiment, the media converting process may utilize a printing press to print the subject matter on the thermal print media 20. The printing press may employ lithographic, ultra violet lithographic, flexographic or inkjet printing. Other printing methods, such as the gravure method, may also be employed in the media converting process. In another embodiment, the media converting process may also utilize thermal printing techniques to image the above-described subject matter on the thermal print media.

Figure 2C:
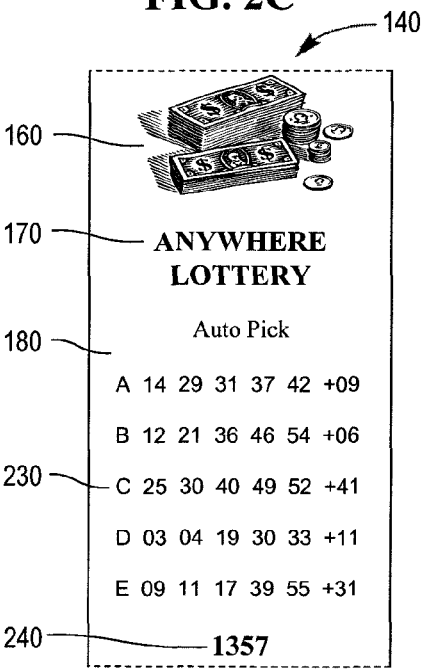
FIGS. 2C-2D illustrate the example first side and the example second side of the preprinted transaction document of FIGS. 2A-2B imaged with a data security feature using the example dual-sided imaging direct thermal printer, in accordance with FIG. 1.
Figure 2D:
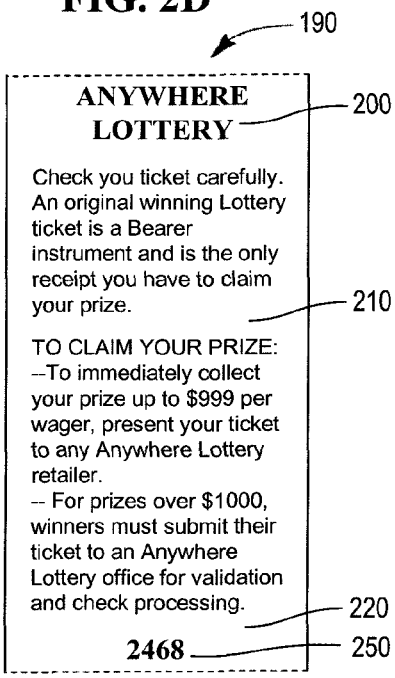

FIGS. 2C-2D illustrate the example first side 140 and the example second side 190 of the preprinted transaction document of FIGS. 2A-2B imaged with a data security feature 240, 250 using the example dual-sided imaging direct thermal printer 10, in accordance with FIG. 1. More specifically, in the printing surface 180 of the first side 140 there is imaged transaction detail 230, which in a lottery industry may represent numbers selected, whether automatically or manually, during a transaction via a point-of sale terminal (POS) that may be connected to the dual-sided imaging direct thermal printer 10 of FIG. 1. In the printing surface 180 of the first side 140 there is also imaged a first data security feature 240. On the second (reverse) side 190, there is imaged a second data security feature 250. The first data security feature 240 may be integrally linked to the second data security feature 250 to provide stronger fraud protection and to provide enhanced ability to authenticate the transaction detail 230 if one of the first and the second data security feature 240, 250 is altered, whether accidentally or fraudulently. The first data security feature 240 and the second data security feature 250 may be considered a combination data security feature.

Further with reference to FIGS. 2C-2D, the first data security feature 240 and the second data security feature 250 may be sequentially linked from the first (front) side 140 to the second (reverse) side 190. For example, the first data security feature 240 may be a first number, such as 1234, and the second data security feature 250 may be a second number, such as 5678, which is sequential to the first data security feature 240. Alternatively, the first data security feature 240 and the second data security feature 250 may be sequentially linked and further may alternate from the first (front) side 140 to the second (reverse) side 190. For example, the first data security feature 240 may be a first number, such as 1357, and the second data security feature 250 may be a second number, such as 2468, which is sequential to and interleaved with the first data security feature 240. Lastly, other available combinations or ways of interlacing or interleaving the first security feature 240 and the second security feature 250 may also be used depending on particular requirements. The transaction detail 230 as well as the data security features 240, 250 may be stored in the POS terminal and/or be transmitted to a centralized location (e.g., data store) administering the industry for later authentication of transaction detail 230.

Still further with reference to FIGS. 2C-2D, the data security features 240, 250 may employ any one or more of the known numbering systems represented by any one or more numeral systems, such as the decimal (base ten) Hindu-Arabic integers illustrated in FIGS. 2C-2D. Alternate numbering and/or numeric systems including natural, negative, integer, rational, irrational, real, imaginary, complex, transcendental and the like numbers represented by Hindu-Arabic, East Asian, Roman alphabetic, and like numerals may also be used. Likewise, alternate positional systems including binary (base two), octal (base eight), hexadecimal (base sixteen), and the like numerals may be used. Other numbering and/or numeric systems including alphanumeric numbering, consecutive bar code numbering, modulus numbering, gothic numbering, magnetic ink character recognition (MICR) numbering, optical character recognition (OCR) numbering, CMC7 numbering, a 2D consecutive bar code numbering, or combinations of these and/or the above, may also be employed for the data security features 240, 250.

Lastly with reference to FIGS. 2C-2D, the data security features 240, 250 printed by the dual-sided thermal printer 10 of FIG. 1 on a transaction document provide a unique level of security and may be stored in a database (not shown) along with specific details, such as a transaction date (not shown) and transaction detail 230. This stored data, including transaction detail 230 and data security features 240 and 250, may be recalled later and compared to a physical transaction document that may be submitted for authentication, such as for a winning claim. Thus, the authenticity of the transaction document may be confirmed. Furthermore, the first and the second data security features 240, 250 may be used in situations of physical damage to a transaction document. For example, some or all of the transaction detail 230 may be illegible on a first side 140, and/or one of the data security features 240, 250 may be illegible. The legible data security feature may be used to retrieve the illegible data security feature and the associated transaction detail 230, which may be used for authenticating the transaction document. It is noted, however, that particular requirements for authenticity may be set forth by an administering body.

Figure 3A:
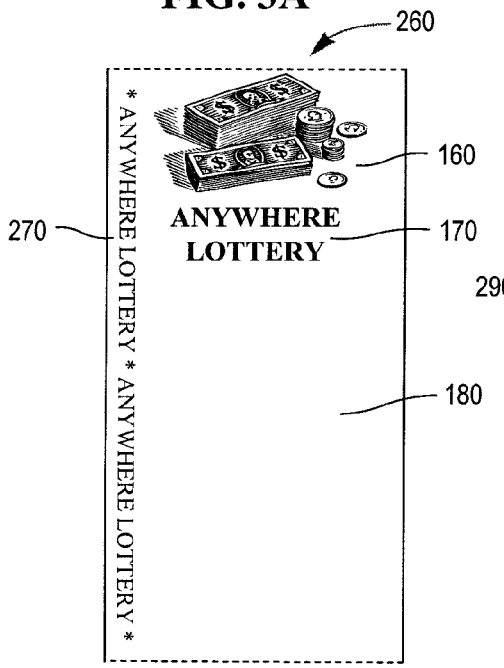
FIGS. 3A-3B illustrate an example first side and an example second side of a preprinted transaction document including an ink security feature for imaging using the example dual-sided imaging direct thermal printer, in accordance with FIG. 1.
Figure 3B:
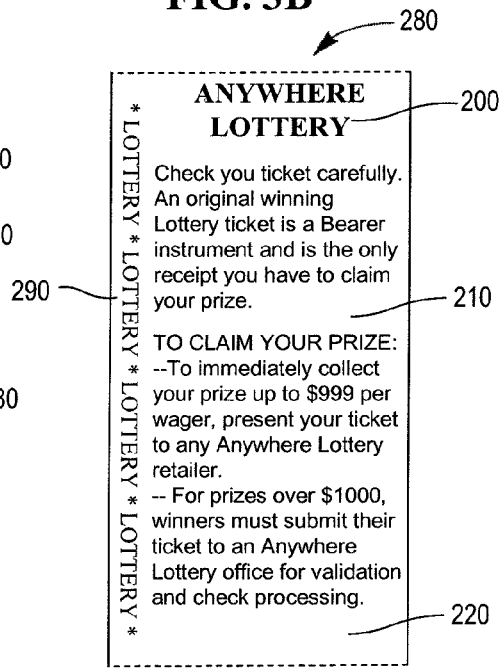

FIGS. 3A-3B illustrate an example first side 260 and an example second side 280 of a preprinted transaction document for imaging using, for example, the dual-sided imaging direct thermal printer 10 in accordance with FIG. 1. As was described hereinabove with reference to FIG. 1, thermal print media 20 including multiple preprinted transaction documents of FIGS. 3A-3B may be supplied in a continuous thermal print media roll, a continuous fan-folded stack, or cut sheet stock for printing transaction documents using the dual-sided imaging direct thermal printer 10 of FIG. 1.

Further with reference to FIGS. 3A-3B, the first (front) side 260 may include a transaction logo 160, a transaction title 170, an ink security feature 270, as well as including a printing surface 180 upon which transaction detail may be imaged using the dual-sided imaging direct thermal printer 10 of FIG. 1. As described herein, the transaction logo 160 may include an embedded logo security. The second (reverse) side 280 may also include a transaction title 200, transaction-related information 210, an ink security feature 290, and printing surface 220. Although the transaction logo 160 is not depicted on the second side 280 for brevity, a transaction logo similar to or different from transaction logo 160 may likewise be preprinted on the second side 280. It is noted that any of the transaction logo 160, transaction titles 170, 200 and transaction-related information 210 may be imaged instead of being preprinted depending on particular requirements of the industry or the application.

Still further with reference to FIGS. 3A-3B, ink security features 270 and 290 may be the same or may be different from one another to enhance fraud protection. Ink security features 270 and 290 must be chemically compatible with the dual-sided thermal media 20. More specifically, the security inks should not pre-image the thermal media 20 prematurely or prevent the thermal media 20 from imaging fully when imaged by the direct thermal printer 10. The ink security features 270 and 290 may include the following described security inks.

An example security ink is a thermochromic ink, which is heat sensitive and which changes to a colorless state or another color when heat is applied (such as by rubbing), reverting to its original color when the heat is removed. It cannot be photocopied, is hard to duplicate and is reusable. A scratch-to-color ink is another example of a security ink, which irreversibly changes from clear or a color to another color by scratching it (such as with a fingernail). The scratch-to-color security ink cannot be photocopied, is hard to duplicate and is not reusable. Yet another example of a security ink is a coin reactive security ink, which may be applied to the dual-sided thermal media 20 in a discreet or covert location. The coin reactive security ink will change to gray when rubbed with the edge of a coin or other metal object. The coin reactive ink cannot be photocopied, is covert, and is hard to duplicate.

Yet further with reference to FIGS. 3A-3B, the security inks may also include a near infrared fluorescent security ink, which may be detected when exposed to light in the near-infrared spectrum, but is invisible to the naked eye. The near infrared fluorescent security ink cannot be photocopied, is hard to duplicate, and is reusable. However, a detection device is required to detect the near infrared fluorescent security ink. Another security ink is a photochromic security ink, which undergoes a reversible color shift when exposed to ultraviolet (UV) light. The color reaction is immediate and the photochromic security ink reverts back to its original color (or colorless) when the UV light is removed. The photochromic security ink may also be activated by natural sunlight. It cannot be photocopied and is reusable. As another security ink, a white or clear ink may be used to produce an artificial watermark appearance, which cannot be photocopied and is reusable. The security ink may include a UV fluorescent ink, which fluoresces under short or long range UV light, or both. Normally, UV fluorescent ink is invisible to the naked eye. It cannot be photocopied and is reusable.

Additionally with reference to FIGS. 3A-3B, the security ink may also include a color shifting ink, such as an optically variable ink, which will appear to be different colors when viewed from different angles. The color shifting ink cannot be photocopied, is hard to reproduce and is reusable. Any of the foregoing security inks or a conventional ink may be used to preprint a unique background or design, which is visible to the naked eye or which may require a key to decode, such as a decoder template placed over the thermal media 20. It is reusable and may be difficult to reproduce depending on the complexity of the background or design. A combination of any of the foregoing security inks may be used for the ink security features 270 and 290 to provide multiple levels of fraud security. In addition to compatibility with the thermal paper 20, when combined, the security inks described herein must also be compatible with each other and must be able to be detected independently to provide intended levels of fraud security.

Still further with reference to FIGS. 3A-3B, the preprinting on the transaction document may follow the manufacturing process of the thermal print media 20 that is described in U.S. Pat. No. 6,784,906, which is incorporated by reference herein. The preprinting may be achieved via a media converting process, which prints the subject mater described above (elements 160, 170, 200, 210, 270, 290) on the thermal print media 20. In an embodiment, the media converting process may utilize a printing press to print the subject matter on the thermal print media 20. The printing press may employ lithographic, ultra violet lithographic, or flexographic printing. Other printing methods, such as the gravure method, may also be employed in the media converting process. The foregoing printing methods may be used in conjunction with thermal printing techniques to image some elements of the above-described subject matter on the thermal print media 20.

Figure 3C:
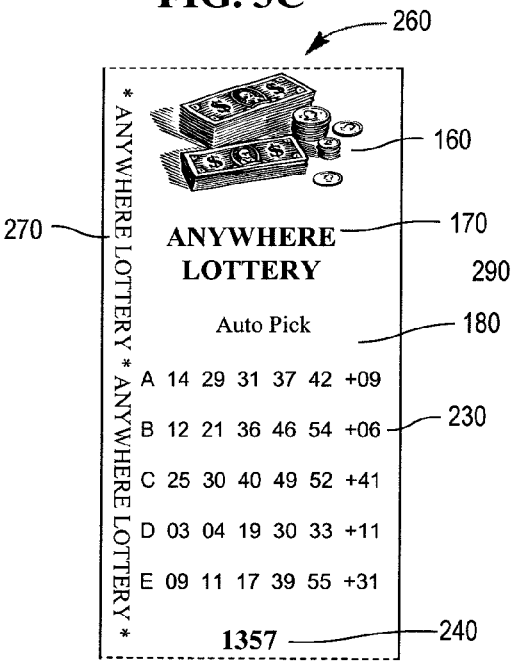
FIGS. 3C-3D illustrate the example first side and the example second side of the preprinted transaction document of FIGS. 3A-3B imaged with a data security feature using the example dual-sided imaging direct thermal printer, in accordance with FIG. 1.
Figure 3D:
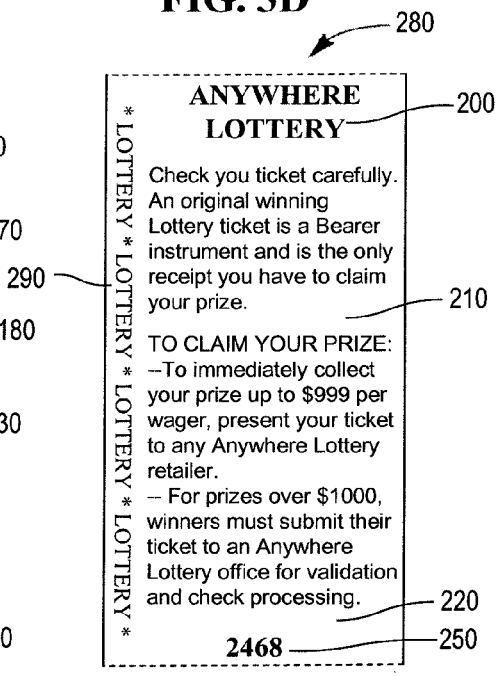

FIGS. 3C-3D illustrate the example first side 260 and the example second side 280 of the preprinted transaction document of FIGS. 3A-3B imaged with a data security feature 240, 250 using the example dual-sided imaging direct thermal printer 10, in accordance with FIG. 1. More specifically, in the printing surface 180 of the first side 260 there is imaged transaction detail 230, which in a lottery industry may represent numbers selected, whether automatically or manually, during a transaction via a point-of sale terminal (POS) that may be connected to the dual-sided imaging direct thermal printer 10 of FIG. 1. In the printing surface 180 of the first side 260 there is also imaged a first data security feature 240. On the second (reverse) side 280, there is imaged a second data security feature 250. The first data security feature 240 may be integrally linked to the second data security feature 250 to provide stronger fraud protection and to provide enhanced ability to authenticate the transaction detail 230 if one of the first and the second data security feature 240, 250 is altered, whether accidentally or fraudulently. The first data security feature 240 and the second data security feature 250 may be considered a combination data security feature. The combination of the data security features 240, 250 and the ink security features 270, 290 provides for greater level of security (fraud protection) than one feature alone.

Further with reference to FIGS. 3C and 3D, and similarly to FIGS. 2C-2D described above, the first data security feature 240 and the second data security feature 250 may employ any one or more of the numbering systems represented by any one or more numeral systems. The first data security feature 240 and the second data security feature 250 may further be sequentially linked from the first (front) side 260 to the second (reverse) side 280. Alternatively, the first data security feature 240 and the second data security feature 250 may be sequentially linked and further may alternate from the first (front) side 260 to the second (reverse) side 280. Other available combinations or ways of interlacing the first security feature 240 and the second security feature 250 are also available. As already described herein, the transaction detail 230 as well as the data security features 240, 250 may be stored in the POS terminal and/or be transmitted to a centralized location (e.g., data store) administering the industry for later authentication of transaction detail 230.

Lastly with reference to FIGS. 3C-3D, and similarly to FIGS. 2C-2D described above, the data security features 240, 250 printed by the dual-sided thermal printer 10 of FIG. 1 on a transaction document provide a unique level of security and may be stored in a database (not shown) along with specific details, such as a transaction date (not shown) and transaction detail 230. This stored data, including transaction detail 230 and data security features 240 and 250, may be recalled later and compared to a physical transaction document that may be submitted as a winning claim. Furthermore, an added level of security may be obtained by employing ink security features 270 and 290 in conjunction with the data security features 240 and 250. The ink security features 270 and 290 in the physical transaction document may likewise be examined. Thus, the authenticity of the transaction document may be confirmed. It is noted, however, that particular requirements for authenticity, such as use of particular data security features and/or security inks, may be set forth by an administering body.

Figure 4:
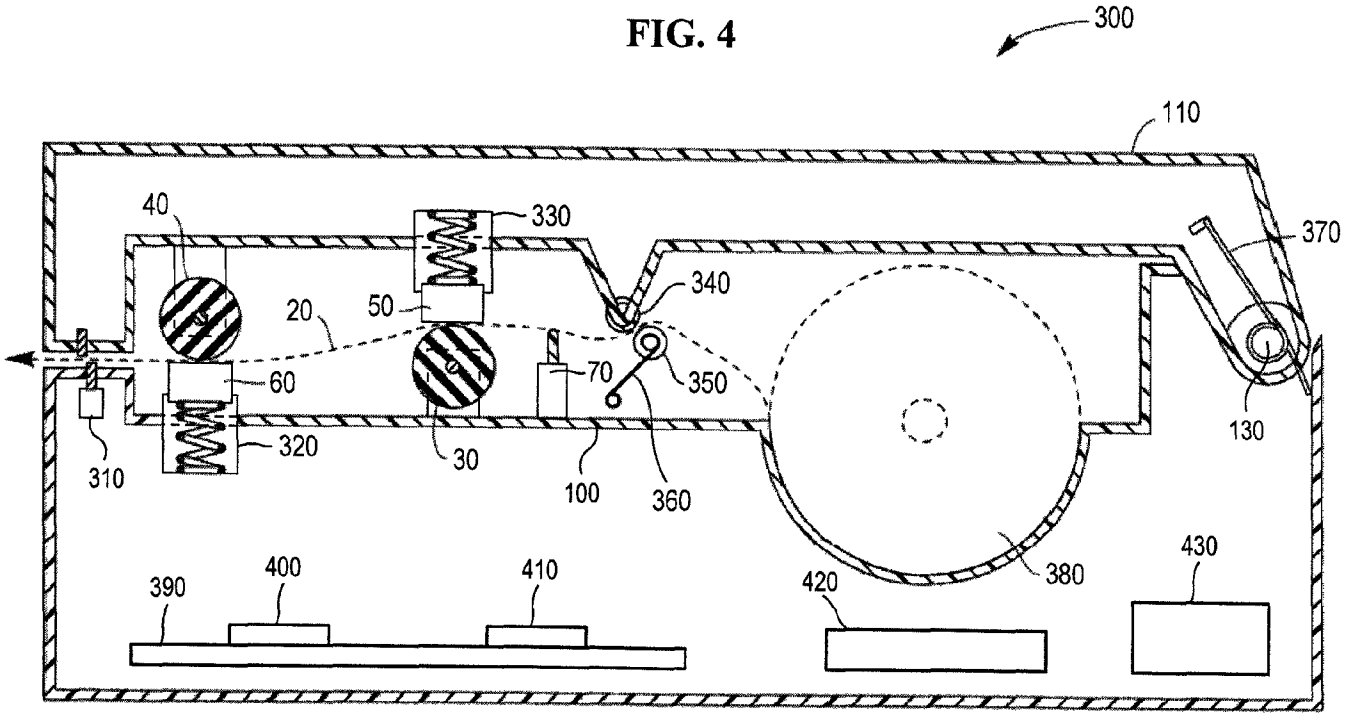
FIG. 4 illustrates a schematic of a partial centerline elevation view of an example dual-sided imaging direct thermal printer for imaging dual-sided transactions documents of FIGS. 2A-2B and 3A-3B, in accordance with FIG. 1.

FIG. 4 illustrates a schematic 300 of a partial centerline elevation view of an example dual-sided imaging direct thermal printer 10 in accordance with FIG. 1. Thermal printer 10 comprises first print head 60, first platen 30, sensor 70 and first guide roller 350, all being coupled to a support arm 100 and all being on a first side of the thermal print media 20. The position of the sensor 70 may be determined based on design requirements of the thermal printer 10 and thermal media 20. It is noted that the feed path of thermal print media 20 is shown by dashed lines of and an arrow at one end of the thermal print media 20. It is further noted that thermal print media 20 may be drawn from a continuous thermal print media roll 380 housed in the interior of the thermal printer 10 between the first support arm 100 and the second support arm 110. It is to be noted that the continuous thermal print media roll 380 may easily be substituted with a continuous fan-folded print media stack or cut sheet stock, similarly housed in the interior of the thermal printer 10. Likewise, in alternate embodiments, any or all of the continuous thermal print media roll 380, continuous fan-folded print media stack or cut sheet stock may be housed on the exterior of the thermal printer 10.

As illustrated in FIG. 4, the thermal printer 10 further comprises a second print head 50, second platen 40 and second guide roller 340, all being coupled to pivotable support arm 110 and all being on a second (reverse) side of the thermal print media 20. The pivotable support arm 110 pivots about the arm shaft (or hinge) 130 to allow replacement of the thermal print media 20 and servicing of the thermal printer. When pivotable support arm 110 is closed in relation to support arm 100, the thermal print media 20 may be engaged between first print head 60 and opposed second platen 40, between second print head 50 and opposed first platen 30, and between first guide roller 350 and opposed second guide roller 340. Contact pressure with and tension of the thermal print media 20 may be maintained by spring loading second print head 50, first print head 60, and first guide roller 350 with spring mechanisms 330, 320 and 360, respectively. The thermal printer 10 also includes spring 370 that enables the pivotable arm 110 to open at a controlled rate in relation to arm 100, and thereby avoid, for example, uncontrolled closing of the arm 110 through force exerted on the arm 110 via the acceleration of gravity. The thermal printer may also include an electronically activated mechanical cutting mechanism 310 to detach the thermal print media 20 upon completion of a print operation, such as the transaction document.

With further reference to FIG. 4, it is noted that the print heads 50 and 60 are substantially in-line and face substantially opposed directions. As a result, the feed path of thermal print media 20 may be substantially a straight line path given the substantially in-line orientation of the print heads 50 and 60. This configuration facilitates frontal exiting of the thermal print media 20 from the thermal printer. The in-line feed path also facilitates automation of thermal print media 20 replacement and feed, which includes allowing the thermal print media 20 to be automatically drawn from the first print head 60 and second platen 40 through the second print head 50 and first platen 30. Although the in-line orientation of print heads 50 and 60 is described, alternate orientations of the first head 50 in respect to the second print head 60, including varied angle orientations (e.g., 45, 90, 135 and 180 degrees), are possible based on particular design requirements of the thermal printer 10, thermal print media 20 and/or desired media feed path.

Still with further reference to FIG. 4, the thermal printer also comprises control electronics for controlling the operation of the thermal printer. The control electronics may include a motherboard 390, a microprocessor or central processing unit (CPU) 400, and memory 410, such as one or more dynamic random access memory (DRAM) and/or non-volatile random access memory (NVRAM) print buffer memory elements. The thermal printer 10 further comprises a communications controller 420 for communicating with one or more host or auxiliary systems, such as a point-of sale terminal (POS) or a computer (FIG. 5) for input of data to and output of data from the thermal printer. Communications controller 420 may support universal serial bus (USB), Ethernet and or wireless communications, among others. The data for printing would typically be supplied by a host POS terminal or a computer communicating with the thermal printer 10 via the communication controller 420.

Lastly with reference to FIG. 4, memory 410 of the dual-sided direct thermal printer 10 may have a predefined print data storage area to store one or more blocks of predefined print data to be repetitively printed on one or both sides of the print media 20. The blocks of predefined print data may include, for example, a store identifier, a logo, and the like. In addition, the blocks of predefined print data may further include legal information such as warranties, disclaimers, return policy, regulatory information, and the like. Thus, the blocks of predefined print data may include the transaction logo 160, transaction titles 170, 200, one or more of the first and second data security features 240 and 250, and transaction-related information 210. Other information not expressly enumerated may also be included in blocks of predefined print data. The predefined print data may be printed along with data submitted by application software associated with the POS terminal or computer on the same or the opposite media side of thermal print media 20. Where multiple data blocks are stored in the predefined print data storage area, the blocks may be alternatively selected for printing through use of a hardware or software switch 430, as may be the location or side of the media on which they are printed, and the like.

Figure 5:
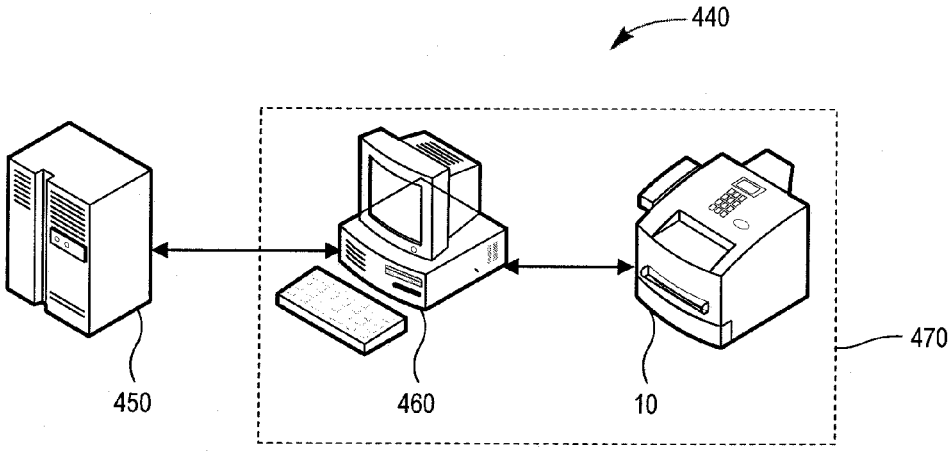
FIG. 5 illustrates schematic of an example system employing dual-sided thermal security features, in accordance with FIGS. 1-4.

FIG. 5 illustrates schematic of an example system 440 employing dual-sided thermal security features in accordance with FIGS. 1-4. The example system 440 includes a data store 450, a POS terminal or computer 460 and the dual-sided thermal printer 10. The POS terminal or computer 460 and the dual-sided printer 10 may be located at location 470, such as a particular store location. The data store 450 may be located at a centralized location that administers a business or an industry (e.g., lottery industry). Alternatively, the data store 450 may be located at location 470, which may be a retail store and the like. The data store 450 is enabled to communicate bidirectionally with POS terminal 460, which in turn is enabled to communicate bidirectionally with dual-sided direct thermal printer 10. The POS terminal 460 may request the data store 450 to provide the first and second data security features 240, 250 for each transaction document that is printed using dual-duded thermal printer 10. Alternatively, the data store 450 may provide an ordered number of sets of data security features 240, 250 that the POS terminal 460 may store and use the sets for multiple transaction documents. The POS terminal 450 or printer 10 may further store the transaction logo 160, transaction titles 170, 200 and transaction-related information 210. As noted herein, the POS terminal 460 may generate the transaction detail 230, which in a lottery industry may represent numbers selected, whether automatically or manually, during a transaction via the POS terminal 460. In different industries or applications, transaction detail 230 may include other things, such as inventory items purchased and the like, and be generated and/or provided by a central server or data store 450.

Now with particular reference to FIGS. 4 and 5, in a transaction print operation the transaction logo 160, transaction titles 170, 200 and transaction-related information 210 may be transmitted from the POS terminal 460 (or memory 410 of printer 10) to the microprocessor 400 which may control the activation of the print heads 50 and 60 to image the foregoing data on the respective sides of the dual-sided thermal print media 20, as illustrated in FIGS. 2C-2D and 3C-3D. The first and second security features 240, 250 may be requested and received from data store 450 or a set of first and second security features 240, 250 may be selected from plural sets stored at the POS terminal 460. The generated transaction detail 230 along with the first data security feature 240 and the second data security feature 250 may likewise be transmitted from the POS terminal 460 to the microprocessor 400 of printer 10, which may control the activation of the print heads 50 and 60 to image the foregoing data on respective sides of the dual-sided thermal print media 20, as illustrated in FIGS. 2C-2D and 3C-3D. Upon completion of a transaction print operation, the CPU 400 may activate the cutting mechanism 310 to detach the thermal print media 20 as it is advanced and output to the outside the thermal printer 10. Lastly, upon completion of the transaction print operation, the first and second data security features 240, 250 and associated transaction detail 230 may be stored at the POS terminal 460, and may further be transmitted from POS terminal 460 to the data store 450, for later authentication of transaction detail 230 in the transaction document.

In operation of the thermal printer 10, and in accordance with FIGS. 1-5, the thermal print media 20 may be unrolled from the continuous thermal print media roll 380, taken from a continuous fan-folded print media stack or from cut sheet stock, and may be moved along the feed path toward print heads 50 and 60 for dual-sided imaging, after which it may be outputted to the outside of the thermal printer 10. As described above, the transaction logo 160, transaction titles 170, 200 and transaction-related information 210 may be transmitted to the microprocessor 400 of printer 10, which may control the activation of the print heads 50 and 60 to image the foregoing data on the respective sides of the dual-sided thermal print media 20, as illustrated in FIGS. 2C-2D and 3C-3D. It is noted, however, that these elements may be preprinted in a media converting process along with the ink security features 270 and 290. As also described above, the transaction detail 230 along with the first data security feature 240 and the second data security feature 250 may likewise be transmitted to the microprocessor 400 of printer 10, which may control the activation of the print heads 50 and 60 to image the foregoing data on respective sides of the dual-sided thermal print media 20, as illustrated in FIGS. 2C-2D and 3C-3D. Upon completion of the print operation, thermal print media 20 may be detached and output to the outside the thermal printer 10, producing a transaction document.

In view of the foregoing, dual-sided thermal media security features have been described. A first data security feature 240 and a second data security feature 250 may be provided on respective sides of the dual-sided thermal media 20 to provide a first level of improved fraud protection and other associated benefits. The data security features 240 and 250 may be sequential to one another and may further be interleaved, as described herein. The first and second data security features 240, 250 may be used in a variety of ways to mitigate fraud. Particularly, the data security features 240, 250 may be used to identify the location 470, the POS terminal 460, the dual-sided thermal printer 10, the transaction document (FIGS. 2C-2D and 3C-3D) and the like in authenticating the transaction document (e.g., a winning claim) and therefore mitigating fraud.

Furthermore, the data security features 240 and 250 may be combined with one or more ink security features 270 and 290 to provide a second level of fraud protection. In addition, a logo 160 may be embedded with a logo security feature to provide yet another level of fraud protection. As may be readily appreciated, multiple levels of dual-sided thermal security features provide the strongest security against fraud.

Additionally, a combination of one or more of the foregoing (160, 240, 250, 270, 290) or other security features with dual-sided thermal media 20 provides the strongest protection against fraud because dual-sided thermal media 20 will fully develop in a copier if one tries to make a copy on it. As such, a further dual-sided thermal security feature includes authenticating a transaction document by using, for example, one's fingernail to scratch each side of the document to determine whether it is a dual-sided thermal media 20 and not a fraudulent copy on bond paper or a single-sided thermal media, and the like. That is, scratching may be used to image and authenticate the dual-sided thermal media 20 as described below with more particularity.

It is noted that fraud may occur in a situation where an individual makes a fraudulent copy of a transaction document (e.g., receipt) generated by a retail establishment on bond paper or single sided thermal paper, enters the establishment and selects merchandise identified on the transaction document, then completing the fraud, takes the selected merchandise to a service desk for a refund. The transaction document may be copied or altered electronically many times, resulting in exponential loses due to fraudulent activities. It is often difficult to identify an original transaction document and an electronically altered or reproduced one. The thermally sensitive coating on each side of the dual sided thermal media 20 provides the ability to image both sides of the thermal paper 20 by scratching or rubbing with, for example, a fingernail, a coin or the like, on the front and back surfaces of the dual-sided thermal media 20. Thus, a sales associate at the return desk may image a transaction document by scratching both sides thereof to assure the original nature of the transaction document and allow for return or exchange of the merchandise identified on the transaction document. However, if the transaction document failed to image on both sides as described, the retail establishment may refuse the return or exchange and may further take appropriate security and/or legal action against the individual presenting the transaction document. Thus, in addition to the foregoing fraud mitigating features, having a thermally sensitive coating on both sides offers yet another level of fraud protection, ensuring authenticity of a transaction document using dual-sided thermal media 20.

In alternate embodiments, different portions or regions of dual-sided thermal media 20 may include different thermally sensitive coatings exhibiting different characteristics when scratched, rubbed or the like. For example, a strip, spot, or region of one or both sides of dual-sided thermal media 20 may be coated to image in response to scratching with, for example, a fingernail, while additional spots, strips or regions may be coated or left uncoated so as to not so image. Likewise, each side of dual-sided thermal media 20 may be coated to exhibit different characteristics when scratched, such as imaging in a different color, and the like. Further, such color may comprise a custom color, such as for a particular retail establishment, on one or both sides, or regions of, dual-sided thermal media 20, and the like, thereby providing a further dual-sided thermal security feature. The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the description. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

What is claimed is:

1. A method for providing a security enabled dual-sided thermal medium, the method comprising:

thermally imaging a first side of the dual-sided thermal medium having a thermally sensitive coating on opposing sides with a first data security feature, wherein the first data security feature comprises a first numeral; and thermally imaging a second side of the dual-sided thermal medium with a second data security feature, wherein the second data security feature comprises a second numeral that is interleaved with the first data security feature, the first side and second side of the dual-sided thermal medium are imaged with the first and second data security features via a single pass of the dual-sided thermal medium through a dual-sided thermal printer, during the single pass the thermal medium is fed through the dual-sided thermal printer which has a first print head interfaced to the first side of the thermal medium and a second print head interfaced to the second side of the thermal medium.

2. The method of claim 1, further comprising printing an ink security feature at a location on at least one of the first side and the second side.

3. The method of claim 2, wherein printing further comprises printing the ink security feature with an ink selected from the group consisting of: thermochromic ink; scratch-to-color ink; coin-reactive ink; near infrared fluorescent ink; photochromic ink; a clear ink; ultraviolet fluorescent ink; and color shifting ink.

4. The method of claim 1, further comprising representing the first data security feature and the second data security feature as one or more numerals symbolizing numbers selected from the group consisting of: decimal; binary; octal; hexadecimal; natural; negative; integer; rational; irrational;

real; imaginary; complex; transcendental; alphanumeric; consecutive bar code; modulus; gothic; a magnetic image character recognition (MICR); optical character recognition (OCR); CMC7; and 2D consecutive bar code.

5. The method of claim 1, further comprising imaging the first side and the second side of the thermal medium by scratching.

6. The method of claim 1, further comprising printing a transaction logo at a location on at least one of the first side and the second side of the thermal medium.

7. The method of claim 6, further comprising embedding a transaction logo security feature in the transaction logo.

8. The method of claim 7, wherein the embedding further comprises printing the transaction logo security feature using an ink selected from the group consisting of: thermochromic ink; scratch-to-color ink; coin-reactive ink; near infrared fluorescent ink; photochromic ink; a clear ink; ultraviolet fluorescent ink; and color shifting ink.

9. A security enabled dual-sided thermal medium, the thermal medium comprising:

a thermally sensitive coating on each of a first side and a second side of the dual- sided thermal medium;

a first data security feature disposed at a location on the first side of the dual-sided thermal medium, wherein the first data security feature comprises a first numeral; and a second data security feature disposed at a location on the second side of the dual-sided thermal medium, wherein the second data security feature comprises a second numeral that is interleaved with the first data security feature;

the dual-sided thermal medium is configured to be fed through a dual-sided thermal printer with the first side of the dual-sided thermal medium in contact with a first print head to apply heat and simultaneously the second side of the dual-sided thermal medium in contact with a second print head to apply heat.

10. The dual-sided thermal medium of claim 9, further comprising:

an ink security feature disposed at a predetermined location of at least one of the first side and the second side of the dual-sided thermal medium.

11. The dual-sided thermal medium of claim 10, wherein the ink security feature includes an ink selected from the group consisting of: thermochromic ink; scratch-to-color ink; coin-reactive ink; near infrared fluorescent ink; photochromic ink; a clear ink; ultraviolet fluorescent ink; and color shifting ink.

12. The dual-sided thermal medium of claim 9, wherein the first data security feature and the second data security feature are one or more numerals symbolizing numbers selected from the group consisting of: decimal; binary; octal; hexadecimal; natural; negative; integer; rational; irrational; real; imaginary; complex; transcendental; alphanumeric; consecutive bar code; modulus; gothic; a magnetic image character recognition (MICR); optical character recognition (OCR); CMC7; and 2D consecutive bar code.

13. The dual-sided thermal medium of claim 9, wherein the first side and the second side of the thermal medium are adapted to be imaged by scratching.

14. The dual-sided thermal medium of claim 9, further comprising a transaction logo at a location on at least one of the first side and the second side of the thermal medium.

15. The dual-sided thermal medium of claim 14, further comprising a transaction logo security feature embedded in the transaction logo.

16. The dual-sided thermal medium of claim 15, wherein transaction logo security feature includes an ink selected from the group consisting of: thermochromic ink; scratch-to-color ink; coin-reactive ink; near infrared fluorescent ink; photochromic ink; a clear ink; ultraviolet fluorescent ink; and color shifting ink.

* * * * *